US006282938B1

(12) United States Patent
Mertens et al.

(10) Patent No.: US 6,282,938 B1
(45) Date of Patent: Sep. 4, 2001

(54) METHOD FOR ROLLING A METAL STRIP

(75) Inventors: Werner Mertens, Viersen; Stephan Krämer, Hilchenbach, both of (DE)

(73) Assignee: SMS Scholemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/647,187

(22) PCT Filed: Mar. 30, 1999

(86) PCT No.: PCT/EP99/02198

§ 371 Date: Dec. 18, 2000

§ 102(e) Date: Dec. 18, 2000

(87) PCT Pub. No.: WO99/51368

PCT Pub. Date: Oct. 14, 1999

(30) Foreign Application Priority Data

Apr. 3, 1998 (DE) ..... 198 15 032

(51) Int. Cl.[7] ..... B21B 27/06
(52) U.S. Cl. ..... 72/202; 72/229; 72/365.2
(58) Field of Search ..... 72/202, 229, 365.2

(56) References Cited

U.S. PATENT DOCUMENTS 4,840,051 6/1989 Boratto et al. .
5,195,344 * 3/1993 Masuda et al. ..... 72/202
5,706,690 * 1/1998 Connolly ..... 72/229
5,810,951 * 9/1998 Dorricott ..... 72/229
5,910,184 6/1999 Kneppe et al. .
6,062,055 * 5/2000 Bobig et al. ..... 72/202

FOREIGN PATENT DOCUMENTS 0099520 2/1984 (EP) .
0226446 6/1987 (EP) .
0584605 3/1994 (EP) .
0761326 3/1997 (EP) .

OTHER PUBLICATIONS

Patent Abstracts of Japan, vol. 011, No. 380 (M–650), Dec. 11, 1987 & JP 62 151209 A (Sumitomo Metal Ind Lyd), Jul. 6, 1987.

* cited by examiner

*Primary Examiner*—Ed Tolan
(74) *Attorney, Agent, or Firm*—Friedrich Kueffner

(57) ABSTRACT

The invention relates to a method for rolling a metal strip (6) in a reverse rolling mill (1) with a coiler located upstream and a coiler located downstream (4,5). The metal strip is wound off the upstream coiler (4) with a strip thickness (d) and at a strip temperature (T) above a set temperature (T*). It is then passed through the reverse rolling mill (1) with a first draught of at most 5% and at a speed (v) before being wound up by the downstream coiler (5). The speed (v) at which the strip is passed through the rolling mill is selected with the aim of ensuring that the strip has reached the set temperature (T*) by the time it is wound up. The strip is then wound off the downstream coiler (5), passed through the reverse rolling mill (1) with a second draught of at least 10% and wound up by the upstream coiler (4).

7 Claims, 1 Drawing Sheet

METHOD FOR ROLLING A METAL STRIP

Figure 1:
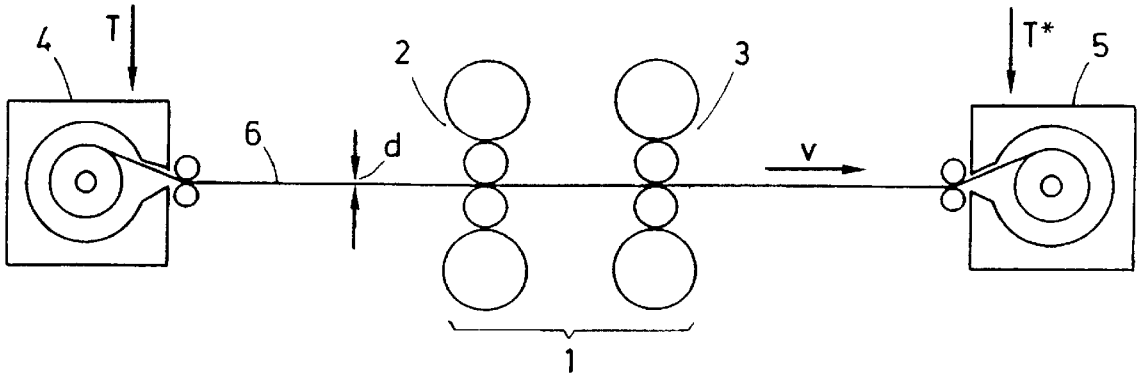

The present invention relates to a method for rolling a metal strip, especially a steel strip, in a reverse rolling mill comprising a coiler upstream and a coiler downstream thereof, wherein the strip is removed from one of the coilers, passes through the reverse rolling mill with a reduction per pass of at least 10%, and is then wound onto the other coiler.

Such rolling mills and the corresponding methods for rolling are known in general. In such rolling mills, the strip is rolled by several back and forth passes (reversing).

Before rolling, the strip has a strip temperature which is often above a desired set point temperature. The object of the present invention is to provide a method by which the strip can be brought as quickly as possible to the desired rolling temperature.

The object is solved in that the strip is removed from the upstream coiler with a strip thickness and with a strip temperature above the set point temperature, passes with a travel speed through the reverse rolling mill with a first reduction per pass of maximally 5%, and is wound up on the downstream coiler, wherein the travel speed is selected such that the strip when being wound up has reached the set point temperature.

In this way, the strip is cooled significantly faster than in a temperature compensation furnace.

In practice, the reduction per pass should be selected as minimally as possible, for example, should be only 1%, because the deformation during rolling increases the strip temperature again. It is optimal when the first reduction per pass is zero, i.e., the rolling mill therefore acts only as a driver with an empty pass.

The desired rolling temperature can be adjusted even more precisely when the strip is heated on the coilers, i.e., the reverse rolling mill is designed as a so-called Steckel mill.

The method according to the invention can be used especially advantageously for performing hot rolling as well as cold rolling of steel in a single rolling mill. It is particularly advantageous when the strip temperature is above the so-called GOS line and the set point temperature is below this line when the metal to be rolled is steel.

The strip thickness, at which the strip temperature is lowered to the set point temperature, is preferably in the range of 5 and 15 mm.

Further advantages and details result from the further claims as well as the following description of one embodiment. In this connection, in a schematic representation the only FIG. 1 shows a Steckel mill.

A Steckel mill is comprised according to the FIGURE of a reverse rolling mill 1 with one or two roll stands 2, 3, having arranged upstream and downstream thereof a coiler 4, 5, respectively. In the Steckel mill a strip 6 is to be rolled, in particular, in an exemplary fashion from a beginning thickness of 50 mm to a final thickness of 1.2 mm. For this purpose, the strip 6 is rolled in a reversing fashion in the Steckel mill. Accordingly, it is removed from one of the coilers 4, 5, passes then through the reverse rolling mill 1, and, subsequently, is wound up again onto the other coiler 4, 5. Subsequently, the operating direction is reversed. Accordingly, the strip 6 is now removed from the other one of the coilers 4, 5 in the next process step, passes through the reverse rolling mill 1, and is then wound up again on the first one of the coilers 4, 5. Each one of these travels through the reverse rolling mill 1 is conventionally referred to as a pass. In order to maintain the strip temperature T of the strip 6 as constant as possible, the coilers 4, 5 are embodied as coiler furnaces in which the strip 6 is heated.

The strip 6 according to the embodiment is a steel strip. The strip 6 is conventionally hot rolled at the beginning. Accordingly, it has a strip temperature T above the GOS line for steel. The strip temperature T is, for example, 1100° C.

The strip 6 is now hot rolled in a reversing fashion in several passes within the reverse rolling mill 1 until its strip thickness d is between 5 and 15 mm, for example, 10 mm. The further rolling to a final thickness of 1.2 mm is to be performed by cold rolling of the strip 6. For this purpose, the strip temperature T of 1100° C. is to be lowered to a set point temperature T* for the cold rolling. The set point temperature T* is below the GOS line for steel and is thus, for example, 700° C.

The lowering of the strip temperature T is carried out as follows.

It is to be assumed that the strip 6 during the last pass of hot rolling has been wound onto the coiler 4, in the following referred to as the upstream coiler 4. The strip 6 is now removed at its strip temperature T from this upstream coiler 4 and passes through the reverse rolling mill 1 at a travel speed v. After passing through the reverse rolling mill 1, the strip 6 is wound onto the other coiler 5, in the following referred to as the downstream coiler 5.

The reduction per pass in the reverse rolling mill 1 is adjusted for this pass as low as possible. Ideally, the reduction per pass is zero. The roll stands 2, 3 of the reverse rolling mill 1 in this case act only as a driver for the strip 6. However, a minimal reduction per pass of, for example, 1%, in any case however of maximally 5%, can be tolerated. The travel speed v can be selected essentially as desired for such a minimal reduction per pass. In particular, the travel speed v can be selected also to be very small. The strip 6 has therefore sufficient time to cool over the travel distance between the two coilers 4, 5 to the set point temperature T*. When being wound up, the strip 6 can therefore have the set point temperature T* of, for example, 700° C.

The now subsequently performed cold rolling is carried out in principle identically to the aforementioned hot rolling. The reverse rolling mill accordingly acts again as a normal rolling mill which reduces the strip thickness d of the strip 6 with each pass, in particular, generally by 20 to 50%, sometimes even by 60% per pass. Only the last pass to reach the final thickness of, for example, 1.2 mm, is usually performed with a smaller reduction per pass of approximately 10%.

Should it not be possible, because of technical conditions, to select the travel speed v of the strip 6 so small that the lowering of the strip temperature T to the set point temperature T* can be performed in a single pass, two or more such cooling passes can be performed, if desired, before the process is continued with further rolling, in this connection, cold rolling.

LIST OF REFERENCE NUMERALS

| | |
|---|---|
| 1 | reverse rolling mill |
| 2, 3 | roll stands |
| 4, 5 | coiler |
| 6 | strip |
| d | strip thickness |
| T | strip temperature |
| T* | set point temperature |
| V | travel speed |

What is claimed is:

1. A rolling method for a metal strip (6) in a reverse rolling mill (1) with an upstream and a downstream coiler (4, 5), wherein the strip (6) with a strip thickness (d) is removed from the upstream coiler (4) at a strip temperature (T) above a set point temperature (T*), passes through the reverse rolling mill (1) with a first reduction per pass of maximally 5% at a travel speed (v) and is wound up by the downstream coiler (5), wherein the travel speed (v) is selected such that the strip (6) has reached the set point temperature (T*) when being wound up, and wherein the strip (6) is then removed subsequently from the downstream coiler (5), passes through the reverse rolling mill (1) with a second reduction per pass of at least 10%, and is wound up by the upstream coiler (4).

2. The rolling method according to claim 1, wherein the first reduction per pass is maximally 1%.

3. The rolling method according to claim 2, wherein the first reduction per pass is zero.

4. The rolling method according to claim 1 wherein the second reduction per pass is at least 20%.

5. The rolling method according to claim 1 wherein the strip (6) is heated in the coilers (4, 5).

6. The rolling method according to claim 1 wherein the metal strip is comprised of steel, that the strip temperature (T) is above the GOS line for steel, and that the set point temperature (T*) is below the GOS line for steel.

7. The rolling method according to claim 1 wherein the strip thickness (d) is between 5 and 15 mm.

* * * * *